US005191350A

United States Patent [19]

Hemmie

[11] Patent Number: 5,191,350

[45] Date of Patent: Mar. 2, 1993

[54] LOW WIND LOAD PARABOLIC ANTENNA

[75] Inventor: Dale L. Hemmie, Burlington, Iowa

[73] Assignee: Conifer Corporation, Burlington, Iowa

[21] Appl. No.: 732,651

[22] Filed: Jul. 19, 1991

[51] Int. Cl.[5] ..... H01Q 15/16; H01Q 19/12

[52] U.S. Cl. ..... 343/840; 343/916

[58] Field of Search ..... 343/838, 840, 912, 915, 343/916

[56] References Cited

U.S. PATENT DOCUMENTS 4,295,143 10/1981 Winegard et al. ..... 343/840

4,527,167 7/1985 Miladinovic ..... 343/840

OTHER PUBLICATIONS

Jerrold-UHF Stacked Bowties and UHF Yagi Antennas.

Channel Master-Stop By. Booth No. 24.

Block Down Converters by Pacific Monolithics.

Lance Industries-Microwave 3 Ft., 4 Ft. or 6 Ft. Dish Parabolics.

CableVision-Tanner Electric Systems Technology, Inc.

Microwave Section Parabolics by Lance Industries.

MDS Receiving Equipment by Conifer.

Channel Master Wireless Cable Equipment by Channel Master.

*Primary Examiner*—Michael C. Wimer

*Attorney, Agent, or Firm*—Dorr, Carson, Sloan & Peterson

[57] ABSTRACT

A parabolic low wind load antenna for receiving incoming MMDS signals wherein the antenna is essentially constructed of two identically formed, one-piece reflective halves connected together to form a rectangular shaped parabolic antenna. Each of the reflector halves comprises a substantially U-shaped rigid frame being parabolically shaped in the length dimension and being parabolically shaped in the width dimension. A plurality of reflector elements of circular cross-section and of equal length are oriented in parallel relationship to each other and are spaced apart from each other at a predetermined spacing of about ten percent of the MMDS wavelength. The predetermined spacing is determined in a plane perpendicular to the path of the incoming signals and each of the reflected elements is connected at its terminal ends to the sides of the U-shaped frame. Each of the reflector elements is formed in a full parabolic shape in the width dimension. Connectors are formed on the ends of the sides of the U-shaped frame for providing connection to the other identical reflector half. Near the center of the U-shaped frame is an additional structural parallel support for supporting the center of the linear reflector elements. These supports also terminate in connectors to which the feed of the antenna is connected and supported. All of the structural elements including the reflector elements are of a circular cross-section.

7 Claims, 5 Drawing Sheets

LOW WIND LOAD PARABOLIC ANTENNA

BACKGROUND OF THE INVENTION

Related Application

This is related to co-pending application entitled "Stacked Dual Diple MMDS Feed" filed Jul. 19, 1991, U.S. Ser. No. 07/733,108.

Field of the Invention

This invention relates to parabolic antennas and, more particularly, to parabolic antennas which have low wind load characteristics that are suitable for multichannel multiple distribution service (MMDS).

Statement of Problem

Dish-shaped parabolic antennas are well known. Such antennas come in a variety of shapes and sizes, all of which are readily identifiable by a solid or mesh dish configuration having a three-dimensional parabolic surface with a feed mounted in the focal region of the parabolic surface. Such parabolic dish antennas are frequently used in satellite and TVRO communication systems.

However, such dish-shaped antennas have a common problem in the characteristic high wind load that is exhibited. Not only must the antenna dish itself be structurally designed to withstand high wind forces but the corresponding support structure must also be so designed. Generally speaking, such common dishtype parabolic antennas and their support structure are heavy and sturdy enough to withstand substantial environmental forces. Additionally, dish-type parabolic antennas are difficult to transport because they occupy a significant volume of space. Such antennas are also not well suited for roof-top installations.

Generally rectangular-shaped parabolic antennas have been designed for use on roof tops for receiving delivered programming from a central antenna location. An example of such a patented approach is set forth in U.S. Pat. No. 4,295,143. This patent provided an inexpensive consumer parabolic antenna for use in multipoint distribution service (MDS) of programming for the over-the-air pay TV marketplace (also termed wireless cable). Multi-channel MDS (MMDS) programming utilizes a common carrier transmitter to extend a number of programming signals to roof top parabolic antennas in a 15–25 mile radius from the transmitter. Such roof top parabolic antennas, as that set forth in the aforesaid patent, must exhibit low wind load characteristics, be easy to transport, and must be capable of being mounted on conventional television masts as supports.

A number of differently constructed MMDS parabolic antennas are commercially available. For example, CHANNEL MASTER, a division of Avnet, Inc., P.0. Box 1416, Industrial Park Drive, Smithfield, NC, 27577, has a commercially available parabolic antenna which utilizes parabolic elements of different lengths placed on a main parabolic tubular support or placed on two side by side tubular parabolic supports (a cross brace is utilized on the two side by side supports). Lance Industries Incorporated, 13001 Bradley Avenue, Sylmar, CA 91342, manufactures several types of parabolic antennas including a rectangular shaped parabolic antenna having a plurality of equal length loops disposed on a center wire looped support (Models 18 and 21).

Lance, in its Model 24, also utilizes additional linear support in the region near the loop ends.

Another type of cylindrical parabolic reflector is that of Jerrold, which contains a plurality of equal length linear elements disposed on a central parabolic-curved support which utilizes the support hole as a center brace. In the Jerrold Model JUP-4, rather than using a center parabolic shaped support, a rectangular frame curved parabolically along its longitudinal axis is utilized with the linear reflector elements being disposed on the frame so as to have their opposing ends extend outwardly therefrom. Again, the support post is also used as a brace for the antenna.

With the wide spread growth of MMDS programming, a need exists in the marketplace for a low cost parabolic antenna that exhibits stability in high wind load, and yet provides significant gain for quality reception.

Solution to the Problem

The present invention provides a solution to the above problem by providing a low wind load rectangular shaped parabolic antenna composed of two identically formed reflector halves Each reflector half is die cast from lightweight material and, therefore, only one part need be manufactured to fully form the parabolic reflector for the antenna. This represents a significant improvement over the above discussed approaches where numerous components need to be separately manufactured, inventoried and assembled. Furthermore, because of the unique design of the rectangular shape of the antenna, the antenna offers a significant resistance to environmental forces while maintaining quality reception.

SUMMARY OF THE INVENTION

A parabolic low wind load antenna for receiving incoming MMDS signals wherein the antenna is essentially constructed of two identically formed, one-piece reflective halves connected together to form a rectangular shaped parabolic antenna. Each of the reflector halves comprises a substantially U-shaped rigid frame being parabolically shaped in the length dimension and being parabolically shaped in the width dimension. A plurality of reflector elements of circular cross-section and of equal length are oriented in parallel relationship to each other and are spaced apart from each other at a predetermined spacing of about ten percent of the MMDS wavelength. The predetermined spacing is determined in a plane perpendicular to the path of the incoming signals and each of the reflected elements is connected at its terminal ends to the sides of the U-shaped frame. Each of the reflector elements is formed in a full parabolic shape in the width dimension Connectors are formed on the ends of the sides of the U-shaped frame for providing connection to the other identical reflector half. Near the center of the U-shaped frame is an additional parallel support for supporting the center of the linear reflector elements. These supports also terminate in connectors to which the feed of the antenna is connected and supported. All of the structural elements including the reflector elements are circular in cross-section.

DESCRIPTION OF THE DRAWINGS

FIG. is a perspective of the MMDS antenna of the present invention.

DESCRIPTION OF THE PREFERRED EMBODIMENT

Figure 1:
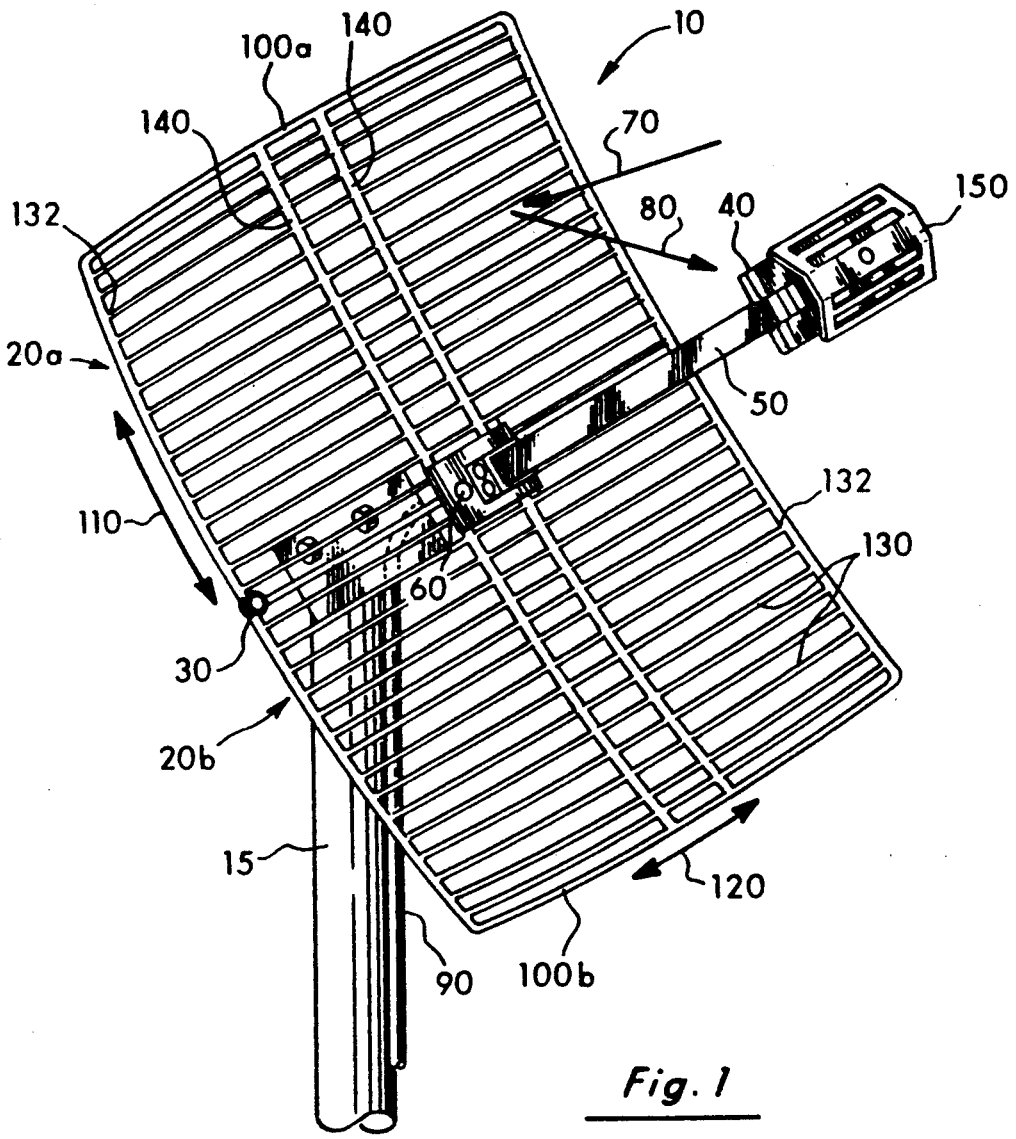

In FIG. 1 the details of the antenna 10 of the present invention are shown. The parabolic low wind load antenna 10 has two identically formed halves 20*a* and 20*b*. These two halves 20 are interconnected at points 30 by means of a rivet or the like. A feed 40 is located at the focal area of the antenna 10 and is mounted on a feed support 50. The feed support 50 is interconnected to the antenna 10 at points 60. Incoming electromagnetic signals 70 are reflected into the feed as shown by lines 80 and a programming signal is picked up and delivered from the antenna over cable 90.

Each of the reflector halves 20 forming the antenna 10 of the present invention includes a generally U-shaped rigid frame 100 with the orthogonal sides being half-parabolically shaped in the length dimension as shown by arrows 110 and fully parabolically shaped in the width dimension as shown by arrows 120. Each reflector half 20 also includes a number of reflector elements 130 which are oriented in parallel relationship to each other and which are spaced apart from each other at a predetermined spacing which, in the preferred embodiment, is about 10% of the predetermined wavelength of the incoming signal 70. The antenna is designed to receive "S-Band" (2.0/3.0 GHz) frequencies. From the viewpoint of the transmitted signals 70, the antenna 10 appears to be electrically solid despite the predetermined spacings between each of the elements 130. Each element 130 is formed in a parabolic shape shown by arrows 120. The ends 132 of each of the reflector elements 130 are connected to the sides of the U-shaped frame 100. Center supports 140 are provided and provide support not only to the half-reflector elements 20, but also at points 60 for the feed 40. Finally, the antenna 10 has a reflector 150 on the end of support 50 for re-directing reflected signals 80 downwardly into feed 40.

Half-Reflector Element 20

Figures 2, 3, 4:
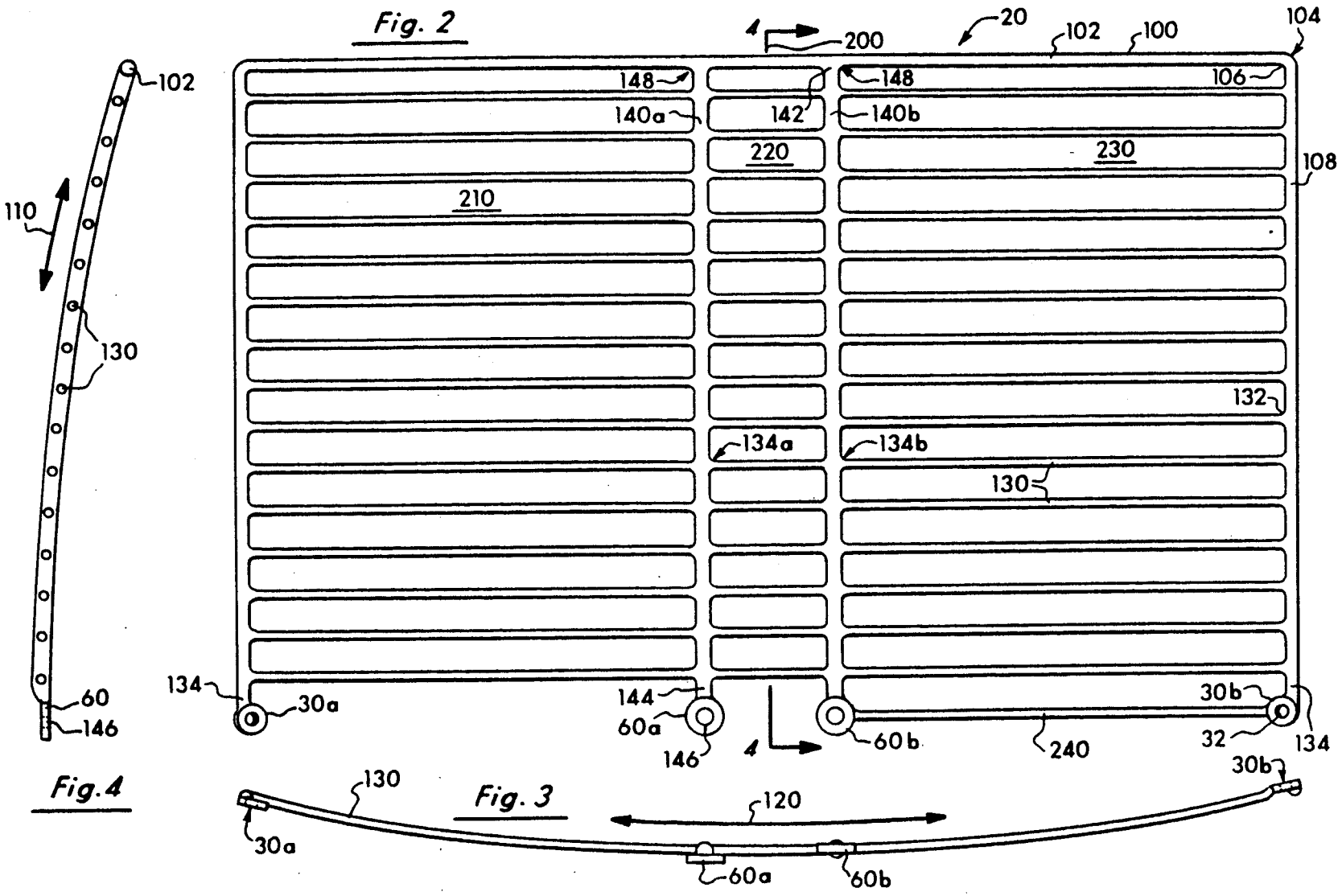
FIG. 2 is a front planar view of the half-reflector element of the present invention.
FIG. 3 is an end planar view of the element of FIG. 2.
FIG. 4 is a side planar view of the element of FIG. 2.

In FIGS. 2–4, the details of a one-piece formed reflector half 20 is set forth.

As shown in FIG. 2, and in the preferred embodiment, the antenna reflector half 20 is made from die cast magnesium according to a hot metal process. The use of magnesium reduces antenna weight since less metal is required. The resulting casting as shown in FIGS. 2 through 4 is lightweight, rigid and constructed in one piece. As shown in FIG. 2, the generally U-shaped or rectangular-shaped frame 100 terminates with the legs 134 of the U-shape construction having circular connectors 30*a* and 30*b*. As shown in FIG. 3, circular connector 30*a* is oriented in a lower direction whereas circular 30*b* is oriented in an upper direction. These two circular connectors 30*a* and 30*b* must be opposite in relationship (i.e., lower vs. upper) so that the other identical half element can positively engage the circular connectors 30 of the first element half. This will be illustrated later. Each circular connector 30 has a formed hole 32 for receiving a rivet or the like.

The frame 100 is circular in cross section having a preferred diameter of 0.188 inches. The upper portion 102 which forms the bottom of the U-shaped frame 100 not only provides structural strength to the antenna, but also provides part of the reflective surface for reflecting the incoming signal 70 to the feed 40. The corners 104 of the U-shaped frame are orthogonal and curved as well as the insides 106 to provide more aerodynamic characteristics.

Near the center 200 of the U-shaped frame 100 are disposed two linear supports 140*a* and 140*b* which are integral at one end 142 to the bottom 102 of the frame 100 and which terminate at the opposite end 144 in circular bosses 60. Each circular boss 60 has a formed hole therein 146. Again, as shown in FIG. 3, boss 60*a* is oriented in a lower or bottom plane whereas boss 60*b* is oriented in an upper or top plane. Again, this arrangement is such that when the other identical half element is connected to bosses 60 of the first identical half, the bosses will positively mate. This will also be illustrated subsequently.

Each of the inner supports 140 is also of circular cross section having a diameter of 0.250 inches. Again, the inner supports 140 are integral with the U-shaped frame at points 148 and they are rounded for aerodynamic flow. The inner supports 140 do not contribute much to the overall electrical performance of the antenna but do provide substantial structural strengthening of the antenna as well as for the feed 40. As shown in FIG. 2, the inner supports 140 are parallel to the orthogonal sides 108 of the U-shaped frame 100.

A plurality of reflector elements 130 (sixteen in the preferred embodiment) are formed between the orthogonal sides 108 of the U-shaped frame and the inner supports 140 as shown in FIG. 2. These reflector elements 130 are parallel to each other and are spaced from each other at a predetermined value of about 10% of the wavelength of the incoming signal. The spacing of 10% is determined along the curve 110 as shown in FIG. 4. If a greater than 10% spacing is utilized, the electrical performance of the signal degrades. Again, each element 130 is integral at each end 132 with the sides 108 of the U-shaped frame 100. Each element is also integral at points 134*a* and 134*b* with the inner support members 140. As shown in FIG. 2, a lattice or honeycomb effect is achieved wherein slots 210, 220 and 230 are formed across the reflector half 20. These formed slots between the elements 130 permit significant passage of environmental forces such as wind, while the U-shaped frame 100 and inner support 140 construction provide significant strengthening to the antenna. Each reflector element 130 has a cross section with a diameter of 0.188 inches in the preferred embodiment. The predetermined spacing of 10% for the MMDS frequencies involved results in a typical spacing of 0.500 inches. Finally, a shortened reflector element 240 is placed between one of the circular bosses 60 and one of the circular connectors 30 (as shown in FIG. 2 between 60*b* and 30*b*). Only a partial reflector element 240 need be placed here since when the other reflector half is installed, it carries the remaining portion of reflector 240 as will be illustrated subsequently.

While components of circular cross-section have been utilized, it is to be expressly understood that other cross-sections and shapes could also be used under the teachings of the present invention such as square, rectangular (e.g., thin plates), or oval.

What has been shown in FIGS. 2–4 is one-half of a shallow dish, rectangular shaped low wind load antenna which can be integrally formed out of one piece. Such an arrangement is inexpensive to manufacture, stockpile and to ship. Furthermore, while specific dimensions have been given in the above, it is to be expressly understood that any of a number of different sets of dimensions can be utilized according to the wavelength of the predetermined signals being received, the curvature of the parabolic shape, and the signal gain desired. The dimensional values given above, while well suited for the MMDS marketplace, are not to limit the teachings of the present invention, nor the signal frequencies of its application.

Connection of Two Reflector Halves

Figure 5:
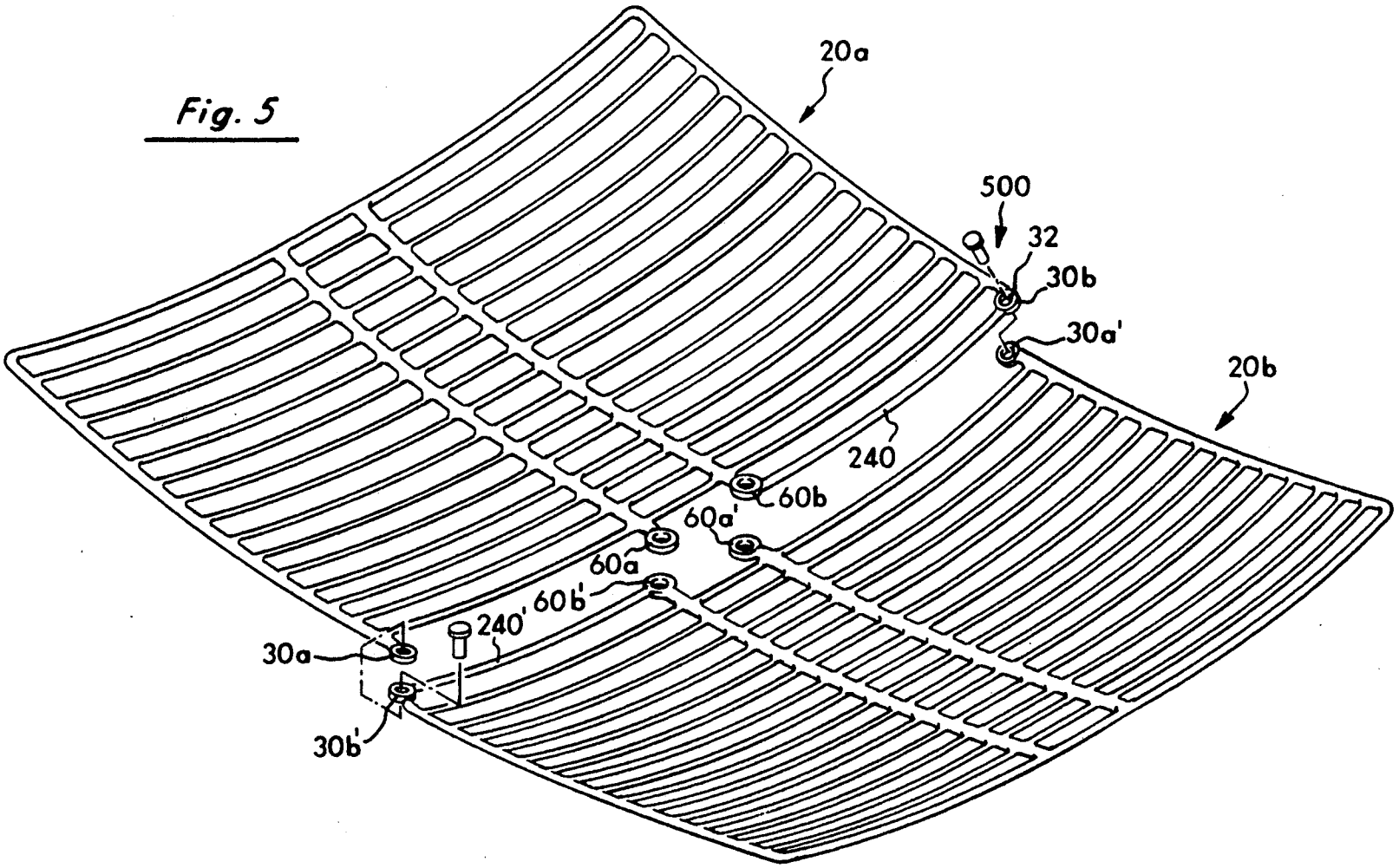
FIG. 5 is a perspective view illustrating the interconnection of the two half-reflector elements together.

FIG. 5 illustrates the connection of the two identically formed half reflector elements together to form a parabolic antenna of the present invention. In FIG. 5, antenna half 20*a* is connected to antenna half 20*b*. Note that circular connector 30*a* engages circular connector 30*b*′ of the other reflective half 20*b*. Likewise, circular connector 30*b* of the first half 20*a* is connected to the circular connector 30*a*′ of the other half 20*b*. The same type of connection occurs with circular feed mounts 60. Rivets 500 are then used through holes 32 to firmly attach the two antenna sections together. It is important to note that the top connectors are 30*b* and 30*b*′ and are located on opposing halves which provides additional torsional strength. Also when the two halves are interconnected partial elements 240 and 240′ are aligned to form the center element to the antenna. The interconnected antenna has 33 elements in the preferred embodiment which number could be more or less depending on the gain desired.

At this stage, the full rectangular-shaped antenna of the present invention has been constructed of only four parts of two basic components: two identical reflector antenna halves and two rivets. This represents a significant savings in inventory, manufacturing, assembly costs and in labor.

Wire Version

Figure 6:
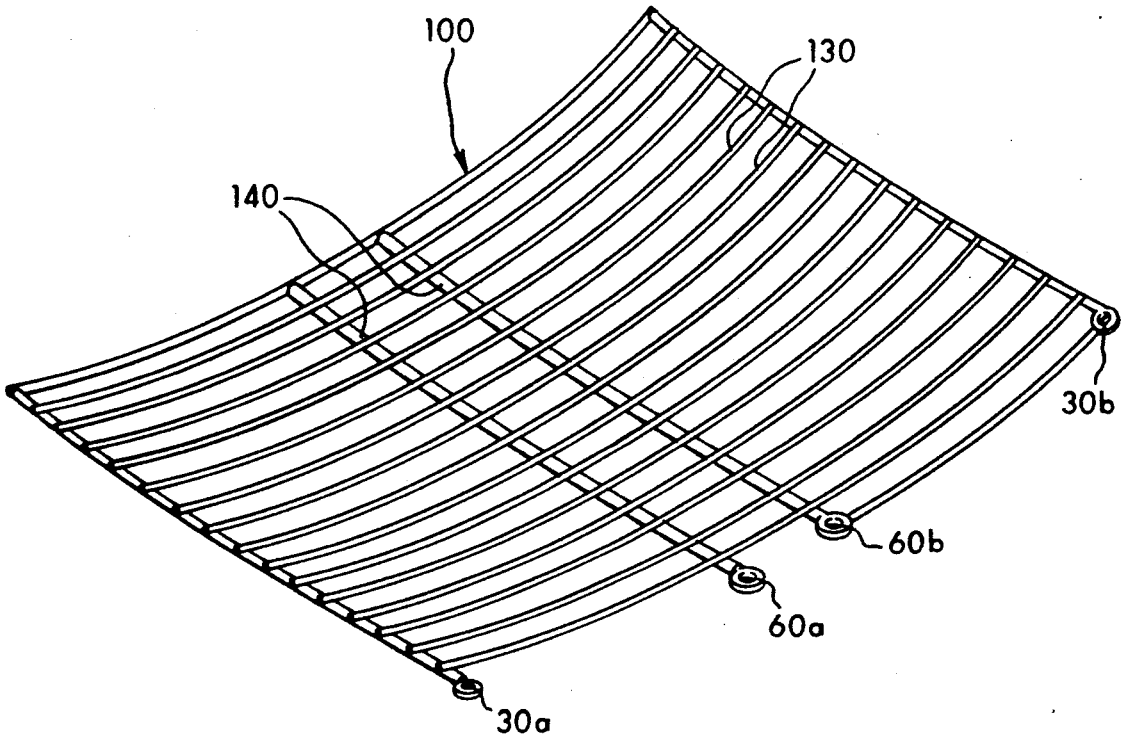
FIG. 6 is a perspective view of a second embodiment of the half-reflector element of the present invention.

In FIG. 6 illustrates a wire version of the die-cast embodiment shown in FIGS. 2–4 of the present invention. The wire version also has a U-shaped frame 100 upon which is soldered reflective wire elements 130. The inner supports 140 are also soldered to the undersurfaces of the wires 130. The formed connectors 30*a* and 30*b* as well as the formed feed mounts 60*a* and 60*b* are likewise soldered onto the frame 100 and the inner support wires 140. Both the antennas of FIG. 6 and of FIG. 2 represent one piece antennas. However, the die-cast approach is an integral one piece construction, whereas the wire version of FIG. 6 requires a separate assembly of a number of parts.

Feed

Figure 9:
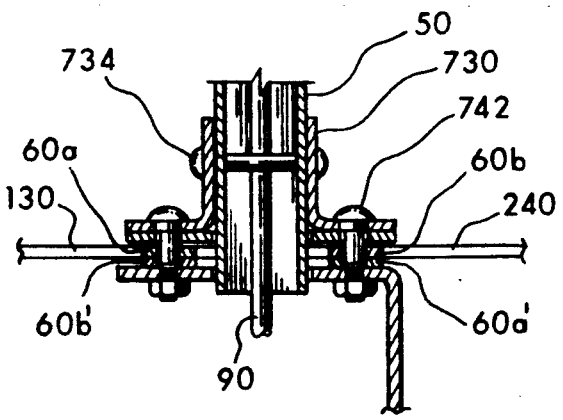
FIG. 9 is a partial cross-sectional view of the feed bracket.
Figure 8:
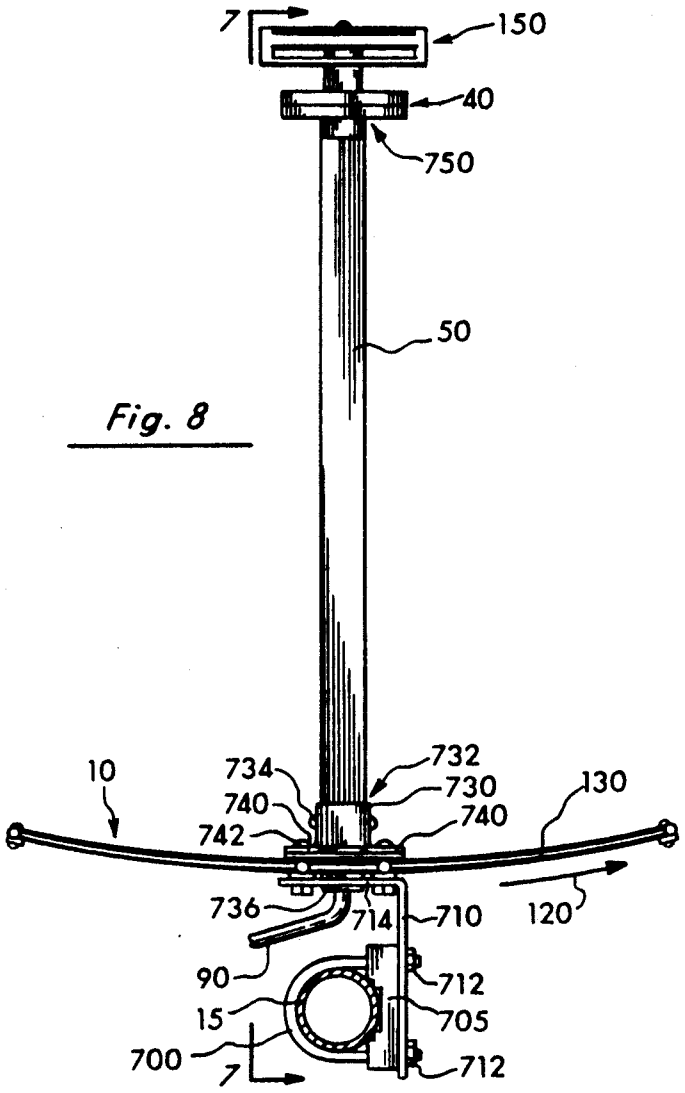
FIG. 8 is a side planar view of the parabolic antenna of FIG. 7.
Figure 7:
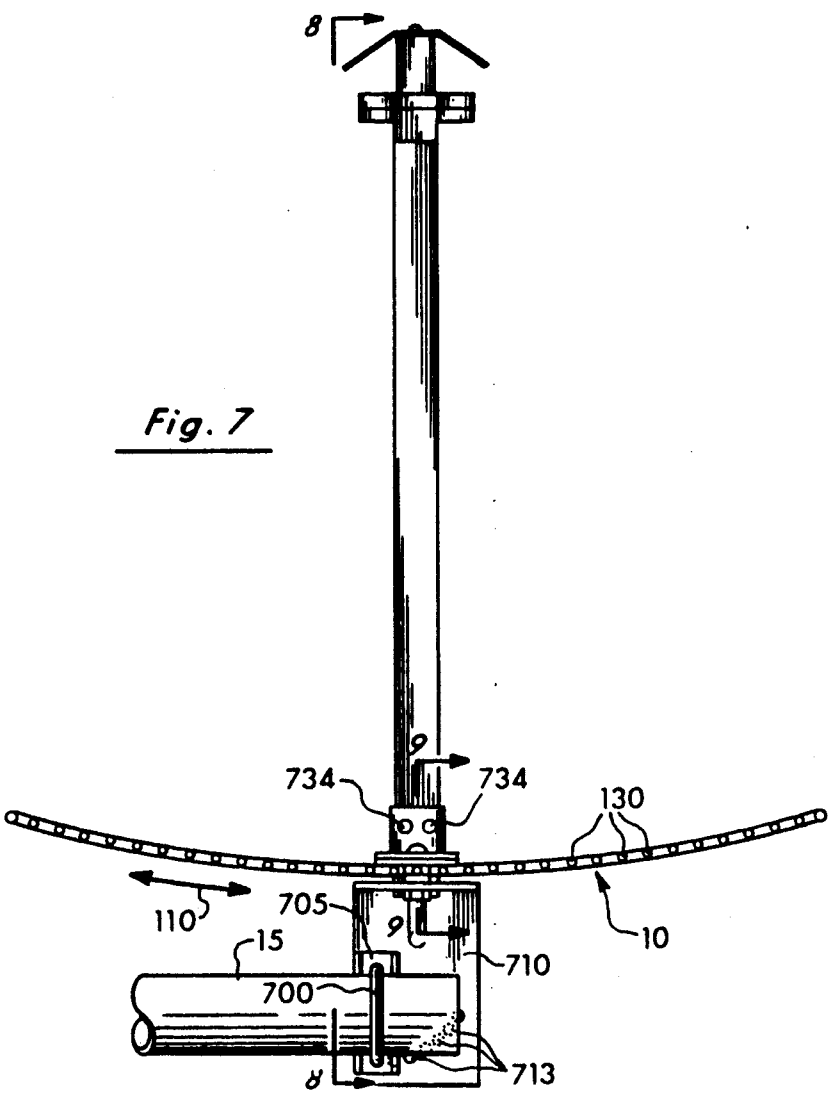
FIG. 7 is an end planar view of the parabolic antenna of the present invention showing the details of the connection of the reflector elements to the mast and the feed horn.

In FIGS. 7 through 9, the mounting of the feed to the parabolic antenna 10 of the present invention is shown. The support mast 15 is a conventional 2 inch diameter tubing. A U-shaped bracket 700 clamps around the outer periphery of support mast 15 and a mast bracket 705 engages the mast 15 so that the mounting bracket 710 is firmly held in place about the mast 15. Conventional hex nuts 712 are utilized to tighten the support bracket 710 down to the mast 15.

As shown in FIG. 7, the mounting bracket 710 has a plurality of orientation holes 713 for selectively locating the angle at which the mounting bracket 710 is oriented with respect to the mast 15. The mounting bracket 710 has a right-angled portion 714 which is mounted to the antenna 10 of the present invention. As shown in FIG. 8, the feed 40 is mounted to align with the direction 120 of the element 130. The support tube 50, in the preferred embodiment, is one inch square aluminum and it engages a feed bracket 730 which is rectangular in shape having a formed hole 732 to receive the square bracket 50. Two rivets 734 are used to firmly affix the tube 50 to the feed bracket 730. It is to be noted that support tube 50 extends downwardly through the antenna 10 to extend into region 736. The connecting cable 90 is delivered through the center of the tube 50. The feed bracket 730 has outwardly extending flanges 740 which, as shown in FIG. 8, extend over the upper surface of the antenna 10 in the vicinity of circular mounts 60*a* and 60*b*. Correspondingly, formed holes are found in the mounting bracket 710 so that a carriage bolt 742 can be utilized to firmly affix each flange 740 to the circular mounts 60*a* and 60*b*′. Carriage bolts 742 firmly attach the antenna 10 to the tubular support 50 and to the mast 15.

The feed 40 is mounted in the focal area 750 of the antenna 10. The sub-reflector 150 is mounted above the feed 40.

Performance

In electrical performance and gain, the antenna of the present invention with the preferred dimensions discussed above has certain advantages when compared to the antenna in U.S. Pat. No. 4,295,143.

The antenna of the present invention reduces the windloading by forty-six percent: the antenna of FIG. 1 exhibits 114 square inches of surface area in comparison to 224 square inches of surface area set forth in the above patent. In sum, the present invention has achieved less windloading due to a smaller surface area with an antenna design that is aerodynamically smoother due to die-cast round elements as opposed to stamped elements with flat surfaces. The use of magnesium instead of aluminum reduces the weight of the antenna. A 10.5 percent reduction in weight occurs (2.46 IDS compared to 2.75 IDS). Finally, less labor is required to manufacture the antenna of the present invention since fewer parts are needed to assemble the antenna, reduced tooling costs are realized due to the use of one symmetrical part which can be combined with another identical part to create a full reflector.

It is to be expressly understood that the claimed invention is not to be limited to the description of the preferred embodiment but encompasses other modifications and alterations within the scope and spirit of the inventive concept such as different dimensions for different frequencies and gains, more or less reflective elements, different shaped crosssections, and the like.

I claim:

1. A parabolic low wind load antenna for receiving incoming signals of predetermined wavelength, said low wind load antenna comprising:

two identical reflector halves, each of said reflector halves comprising:

a U-shaped rigid frame, said U-shaped frame being parabolically shaped in the length dimension of the sides of said U-shaped frame and being parabolically shaped from side-to-side in the width dimension of said U-shaped frame, (b) a plurality of reflector elements of equal length oriented in parallel relationship to each other and spaced apart from each other at a predetermined spacing of about 120% of said predetermined wavelength, said predetermined spacing being determined in a plane perpendicular to the path of said incoming signals, each of said reflector elements having terminal ends, said terminal ends connected to the sides of said U-shaped frame, each of said reflector elements having said parabolic shape in the width dimension of said U-shaped frame, (c) means connected to said U-shaped frame and being oriented perpendicular to said reflector elements for supporting the center of said reflector elements, (d) means located on the ends of said sides of said U-shaped frame for providing antenna connection, (e) mans located on the end of said supporting means for providing feed connection, and means for firmly attaching said antenna connection providing means of each said reflector halves together so that the periphery of the attached reflector halves forms the shape of substantially a rectangle, a feed, and means for connecting said feed to said feed connection means of each said reflector half so that said feed is firmly held in the center of said periphery in the focal area of said antenna.

2. The parabolic low wind load antenna of claim 1 wherein each of said reflector elements has a circular cross-section.

3. A parablock low wind load antenna for receiving incoming signals of predetermined wavelength, said antenna comprising:

two identical reflective halves connected together to form said parabolic antenna having a perimeter in the shape of a substantial rectangle, said antenna having a first parabolic curve in the length dimension of the sides of the rectangular shape of said perimeter and a second parabolic curve from side-to-side in the width dimension of said rectangular shape of said perimeter, each half of said reflective halves comprising:

(a) opposing top and bottom connectors, (b) integral opposing parabolic outer supports having a circular cross-section of a first diameter and extending in said length dimension, said outer supports terminating in said opposing connectors at the center of said length dimension, (c) top and bottom feed mounts, (d) two integral parabolic inner supports having a circular cross-section of a second diameter and extending in said length dimension, each inner support being parallel to said outer supports and spaced near the center of said width dimension, said inner supports terminating in said feed mounts at the center of said length dimension, (e) a plurality of parabolic reflector elements connected to and perpendicular to said inner and outer supports, said reflector elements being spaced at about 10% of said predetermined wavelength, all of said reflector elements being spaced at about 10% of said predetermined wavelength, all of said reflector elements having a circular cross-section equaling said first diameter, (f) a parabolic reflector element of one half of said width dimension connected between one of said opposing connectors and the nearest of said feed mounts, the aforesaid reflector element being parallel to said plurality of reflector elements and being spaced therefrom at said spacing, and means for firmly attaching said two reflective halves together so that the top connector of one of said reflective halves is attached to the bottom connector of the other of said reflective halves, a feed, means for coupling said feed to said top and bottom feed mounts so that the top feed mount of one of said identical reflective halves is coupled to said feed and to the bottom feed mount of the other of said reflective halves, and said second diameter being greater than said first diameter.

4. A parabolic low wind load antenna for receiving incoming signals of predetermined wavelength, said low wind load antenna comprising:

two identical reflector halves, each of said reflector halves comprising:

(a) a substantially U-shaped rigid frame, said U-shaped frame being parabolically shaped in the length dimension of the sides of said U-shaped frame and being parabolically shaped from side-to-side in the width dimension of said U-shaped frame, (b) a plurality of reflector elements of circular cross-section and of equal length oriented in parallel relationship to each other and spaced apart from each other at a predetermined spacing of about 10% of said predetermined wavelength, said predetermined spacing being determined in a plane perpendicular to the path of said incoming signals, each of said reflector elements having terminal ends, said terminal ends connected to the sides of said U-shaped frame, each of said reflector elements having said parabolic shape in the width dimension, (c) means connected to said U-shaped frame and being oriented perpendicular to said reflector elements for supporting the center of said reflector elements, (d) means located on the ends of said sides of said U-shaped frame for providing antenna connection, means for firmly attaching said antenna connection providing means of each of said reflector halves together so that the periphery of the attached reflector halves forms the shape of substantially a rectangular.

5. A parabolic low wind load antenna for receiving incoming signals of predetermined wavelength, said antenna comprising:

two identical reflective halves connected together to form said parabolic antenna having a perimeter in the shape of a rectangle, said antenna having a parabolic curve in the length dimension of the rectangular shape of said perimeter and a parabolic curve in the width dimension of said rectangular shape of said perimeter, each half of said reflective halves comprising:

(a) opposing top and bottom connectors, (b) opposing parabolic outer supports having a circular cross-section of a first diameter and extending in said length dimension, said outer supports terminating in said opposing connectors at the center of said length dimension, (c) two parabolic inner supports having a circular cross-section of a second diameter and extending in said length dimension, each inner support being parallel to said outer supports and spaced near the center of said width dimension, (d) a plurality of parabolic reflector elements connected to and perpendicular to said inner and outer supports, said reflector elements being spaced at about 10% of said predetermined wavelength, all of said reflector elements having a circular cross-section of a third diameter except the reflector element on said perimeter which has a circular cross-section equaling said first diameter, (e) a parabolic reflector element of one half of said width dimension connected to one of said opposing connectors, the aforesaid reflector element being parallel to said plurality of reflector elements and being spaced therefrom at said spacing, and means for firmly attaching said two reflective halves together so that the top connector of one of said reflective halves is attached to the bottom connector of the other of said identical reflective halves, and said second diameter being greater than said first diameter.

6. A parabolic low wind load antenna for receiving incoming signals of predetermined wavelength, said low wind load antenna comprising:

two identical reflector halves, each of said reflector halves being of one-piece construction and integrally comprising:

(a) a substantially U-shaped rigid frame, said U-shaped frame being parabolically shaped in the length dimension of the sides of said U-shaped frame and being parabolically shaped from side-to-side in the width dimension of said U-shaped frame, (b) a plurality of reflector elements of circular cross-section and of equal length oriented in parallel relationship to each other and spaced apart from each other at a predetermined spacing of about 10% of said predetermined wavelength, said predetermined spacing being determined in a plane perpendicular to the path of said incoming signals, each of said reflector elements having terminal ends, said terminal ends connected to the sides of said U-shaped frame, each of said reflector elements having said parabolic shape in the width dimension, (c) means located on the ends of said sides of said U-shaped frame for providing antenna connection, means for firmly attaching said antenna connection providing means of each of said reflector halves together so that the periphery of the attached reflector halves forms the shape of substantially a rectangular.

7. A parabolic low wind load antenna for receiving incoming signals of predetermined wavelength, said antenna comprising:

two identical reflective halves connected together to form said parabolic antenna having a perimeter in the shape of a rectangle, said antenna having a parabolic curve in the length dimension of the rectangular shape of said perimeter and a parabolic curve in the width dimension of said rectangular shape of said perimeter, each half of said reflective halves comprising:

(a) opposing top and bottom connectors, (b) opposing parabolic outer supports having a circular cross-section of a first diameter and extending in said length dimension, said outer supports terminating in said opposing connectors at the center of said length dimension, (c) a plurality of parabolic reflector elements connected to and perpendicular to two interconnected inner supports having a second diameter, and to said supports, said reflector elements being spaced at bout 10% of said predetermined wavelength, all of said reflector elements having a circular cross-section of said first diameter except the reflector element on said perimeter which has a circular cross-section equaling said first diameter, means for firmly attaching said two reflective halves together so that the top connector of one of said identical reflective halves is attached to the bottom connector of the other of said identical reflective halves, and said second diameter being greater than said first diameter.

* * * * *

UNITED STATES PATENT AND TRADEMARK OFFICE

CERTIFICATE OF CORRECTION

PATENT NO. : 5,191,350

DATED : March 2, 1993

INVENTOR(S) : Dale L. Hemmie

It is certified that error appears in the above-identified patent and that said Letters Patent is hereby corrected as shown below:

In Column 1, line 8, change "Diple" to -- Dipole --
In Column 1, line 38, after "Generally", insert -- , --
In Column 2, line 24, after "halves", insert -- . --
In Column 2, line 55, after "dimension", insert -- . --
In Column 2, line 67, after "FIG.", insert -- 1 --
In Column 5, line 44, rewrite "33" in regular type
In Column 5, line 55, delete "In"
In Column 6, line 49, rewrite "114" in regular type
In Column 6, line 50, rewrite "224" in regular type
In Claim 1, Column 7, line 9, before "a", insert -- (a) --
In Claim 1, Column 7, line 17, change "120%" to -- 10% --
In Claim 1, column 7, line 32, change "mans" to -- means --
In Claim 3, Column 7, line 47, change "parablock" to -- parabolic --
In Claim 3, Column 8, lines 9-11, delete "all of said reflector elements being spaced at about 10% of said predetermined wavelength,"
In Claim 3, Column 8, line 12, after "cross-section", insert -- of a third diameter except the reflector element on said perimeter which has a circular cross-section --
In Claim 4, Column 8, line 68, change "rectangular" to -- rectangle --
In Claim 6, Column 10, line 22, change "rectangular" to -- rectangle --
In Claim 7, Column 10, line 43, before "supports", insert -- outer --
In Claim 7, Column 10, line 44, change "bout" to -- about --

Signed and Sealed this

Eleventh Day of January, 1994

Bruce Lehman

*Attest:*

BRUCE LEHMAN

*Attesting Officer*

*Commissioner of Patents and Trademarks*